United States Patent [19]

Palmer

[11] 3,980,267

[45] Sept. 14, 1976

[54] COLLAPSIBLE EASEL MODULE

[76] Inventor: Evan Palmer, 144-24 27th Ave., Flushing, N.Y. 11354

[22] Filed: Oct. 15, 1975

[21] Appl. No.: 622,481

[52] U.S. Cl. ..... 248/463; 248/455; 40/125 H

[51] Int. Cl.[2] ..... A47B 97/04

[58] Field of Search ..... 248/460, 441, 447, 454, 248/455, 456, 457, 462, 463, 464, 465; 211/177; 40/125 H, 125 G, 152.1, 128

[56] References Cited

UNITED STATES PATENTS

| | | | |
|---|---|---|---|
| 782,835 | 2/1905 | Dewey | 248/460 |
| 2,582,070 | 1/1952 | Safer | 248/464 |
| 2,899,204 | 8/1959 | Ratay | 40/125 H |
| 3,095,665 | 7/1963 | Killen | 248/455 |

FOREIGN PATENTS OR APPLICATIONS

| | | | |
|---|---|---|---|
| 272,657 | 6/1927 | United Kingdom | 40/125 H |
| 471,041 | 8/1937 | United Kingdom | 248/460 |

*Primary Examiner*—Robert A. Hafer

[57] ABSTRACT

A collapsible easel module adapted to support flip-chart pads or other material to be displayed, the module having a frame constituted by a front element adjustably coupled to a rear element to assume a caret-like formation. The front element is formed by upper and lower horizontal arms bridged by a pair of parallel legs at points of connection displaced from the ends of the arms. The rear element is formed by corresponding arms bridged by a single leg at points of connection at the midpoint of the arms. The complementary ends of the upper arms of the front and rear elements are joined together by double-barreled couplers which permit adjustment of the caret angle, the same couplers being adapted to accommodate the upper arms of the frame elements of a like module, whereby a series of modules may be joined together to create a free-standing display wall.

9 Claims, 8 Drawing Figures

COLLAPSIBLE EASEL MODULE

BACKGROUND OF THE INVENTION

This invention relates generally to portable display modules, and more particularly to a modular easel which may be readily erected to accommodate flip chart pads or other material to be presented, the easel being joinable to like easels to create a free-standing display wall.

The traditional artist's easel takes the form of a tripod-like frame adapted to hold a canvas at a proper angle for a painter's convenience in working. Inasmuch as the usefulness of an easel is by no means limited to supporting a canvas, over the years it has evolved into a general-purpose support for various types of displays. Thus it is now the practice, in making so-called flip-chart presentations before an audience, to rest the flip-chart pad on an easel at an angle suitable for viewing.

The typical commercial easel, whether made of wood, metal, or plastic, is a relatively cumbersome structure which is somewhat difficult to erect or collapse. Moreover, the conventional easel has an appearance which can best be described as purely utilitarian and altogether lacking in aesthetic appeal.

Since flip-chart presentations are frequently made in the board rooms of major corporations, in university or government conference rooms and in other meeting places having impressive modern appointments, the presence of a typical utilitarian easel in this environment is incongruous and inelegant. Even where the presentation room has a conservative or traditional decor, the placement therein of a typical easel strikes a discordant, out-of-place note.

Furthermore, the typical easel is not well-suited for flip-chart presentations. In a flip-chart, a group of sheets or panels are loosely-bound together at their upper margins to form a pad so that one can readily turn over the top sheet, which then becomes the bottom sheet of the pad, thereby exposing the next sheet to view. A conventional easel is provided with a transverse shelf on which this pad is rested, the vertical position of the shelf being adjustable. Since flip-charts come in various sizes, the present practice requires adjustment of the shelf height to suit the dimensions of the pad. But when it becomes necessary to flip over a sheet, with existing easel designs it is usually necessary to lift the pad away from the easel to make room for the reversed sheet. One cannot simply turn the sheet over the easel itself so that no time is lost in presenting the next sheet to view.

Also, there are some situations where the material to be displayed is much broader than the short shelf of the typical easel, and it is then necessary to bring together two or more easels to support the material. An arrangement of this type is invariably improvised and somewhat insecure in that the several easels are independent of each other, and, unless they are all identical and set up at exactly the same angle, the resultant multi-easel assembly is quite shaky.

SUMMARY OF THE INVENTION

In view of the foregoing, it is the primary object of this invention to provide an easel in modular form, which easel is readily collapsed or erected to define a light-weight and efficient free-standing display frame which is highly attractive as well as utilitarian.

More particularly, it is an object of this invention to provide an easel which is especially adapted for supporting flip-chart pads, the sheets of which may be turned over the easel.

Also an object of the invention is to provide an easel module which may be mass-produced at low cost.

Still another object of the invention is to provide an easel module of the above-type which is joinable to like modules to create a multi-module, free-standing display wall.

A significant feature of the invention resides in the fact that the interconnection of like modules is effected by couplers included in the structure of each module so that auxiliary couplers are not required.

Briefly stated, these objects are attained in a collapsible easel module whose frame is constituted by a front element adjustably coupled to a rear element to assume a caret-like formation. The front element is formed by upper and lower horizontal arms bridged by a pair of parallel legs at points of connection displaced from the ends of the arms. The rear element of the frame is formed by corresponding arms bridged by a single leg at points of connection at the center of the arms.

The complementary ends of the upper arms of the front and rear elements are joined together by doubled-barreled couplers which permit adjustment of the caret angle, the same couplers being adapted to accommodate the upper arms of the front and rear elements of a like module, whereby a series of modules may be joined together to create a free-standing display wall.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
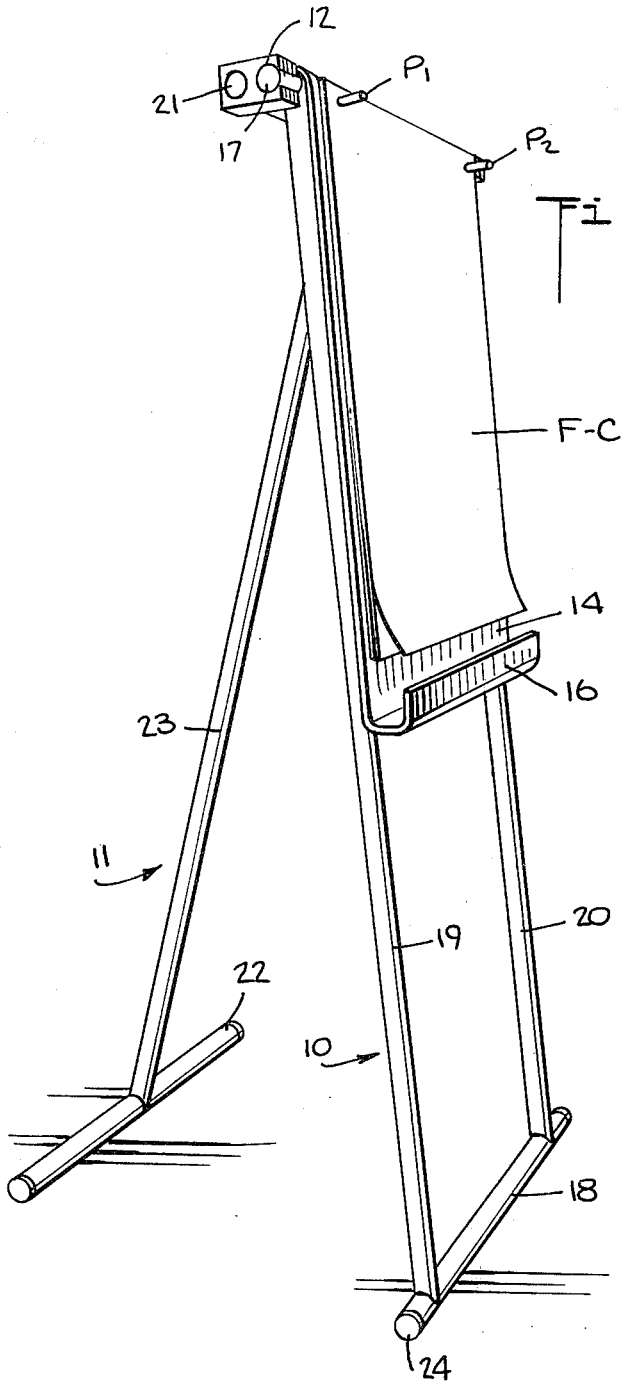
FIG. 1 is a perspective view of a modular easel in accordance with the invention, the easel being shown with a flip-chart pad supported thereon.
Figure 2:
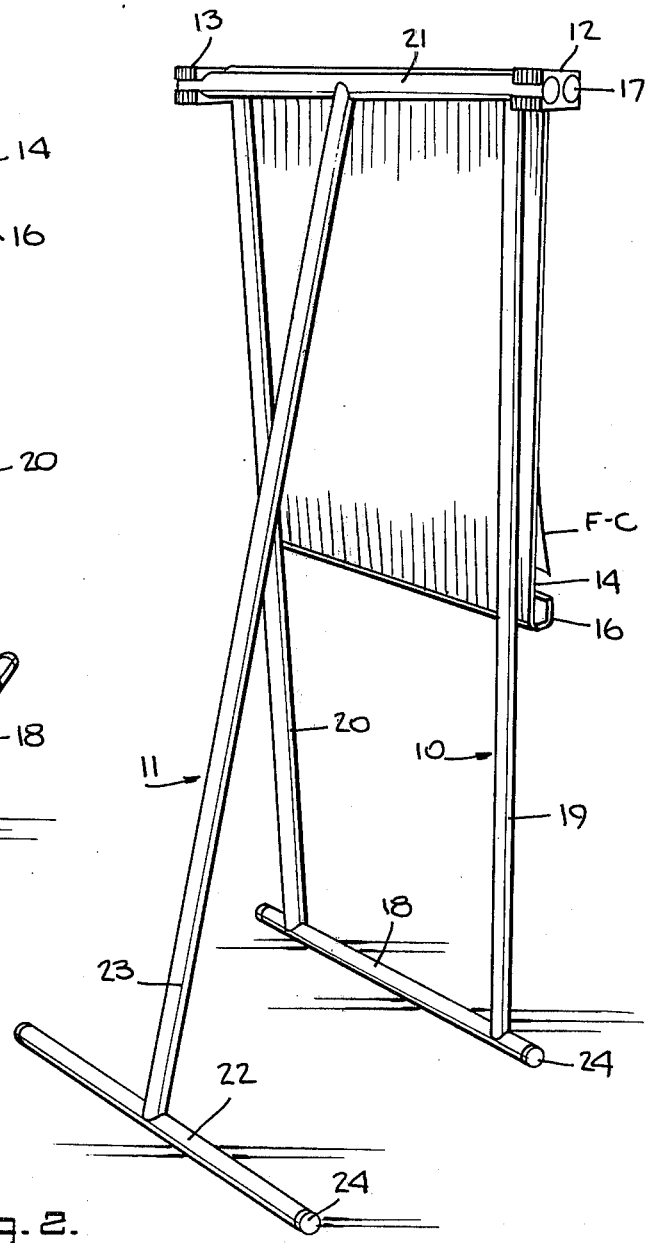
FIG. 2 is a perspective view of the same easel as seen from the rear.
Figure 3:
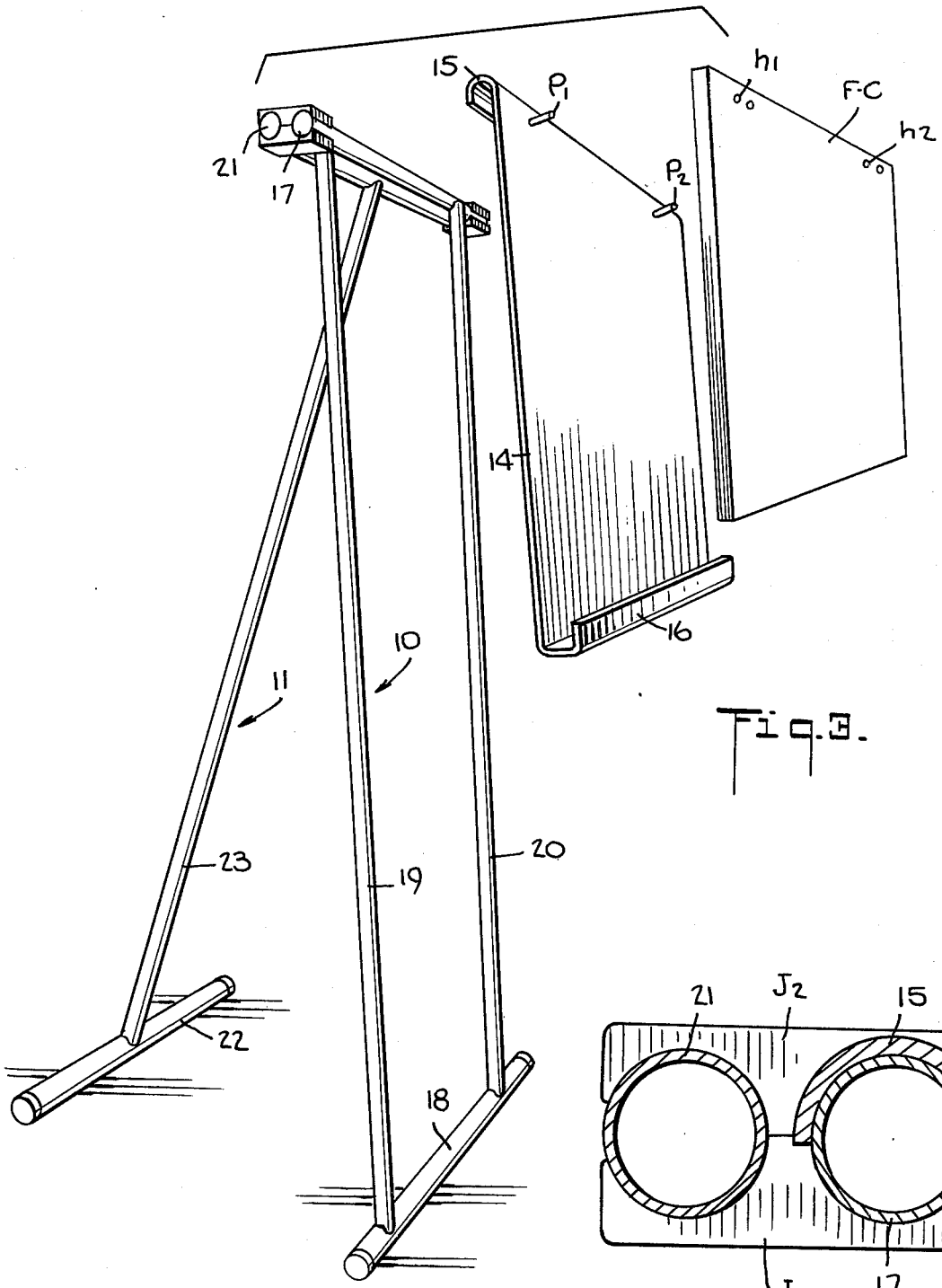
FIG. 3 is an exploded view of the components shown in FIG. 1.
Figure 7:
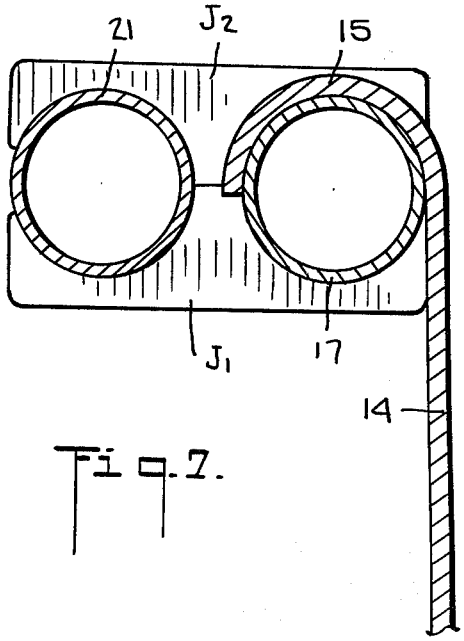
FIG. 7 is a section showing the manner in which the display panel is held between the arm of the frame elements.

Referring now to FIGS. 1 to 3, there is shown a collapsible easel in modular form in accordance with the invention, the easel frame being constituted by a front element, generally designated by numeral 10, and a rear element, by numeral 11. The two frame elements are joined together by a pair of double-barreled couplers 12 and 13 so that they assume an inverted V or caret formation whose angle is determined by the setting adjustment of the couplers.

Lying against front element 10 is a rectangular panel 14 formed of moldable acrylic material such as Plexiglas, whose upper end is curved backwardly to form a rear hook 15 for hanging the panel from the frame, in a manner to be later described, and whose lower end is curved forwardly to define a shelf 16 for supporting material to be displayed against the panel. Panel 14 is provided adjacent its upper end with a pair of pins $P_1$ and $P_2$ for supporting a flip-chart pad F-C having holes $h_1$ and $h_2$ which register with the pins.

Figure 4:
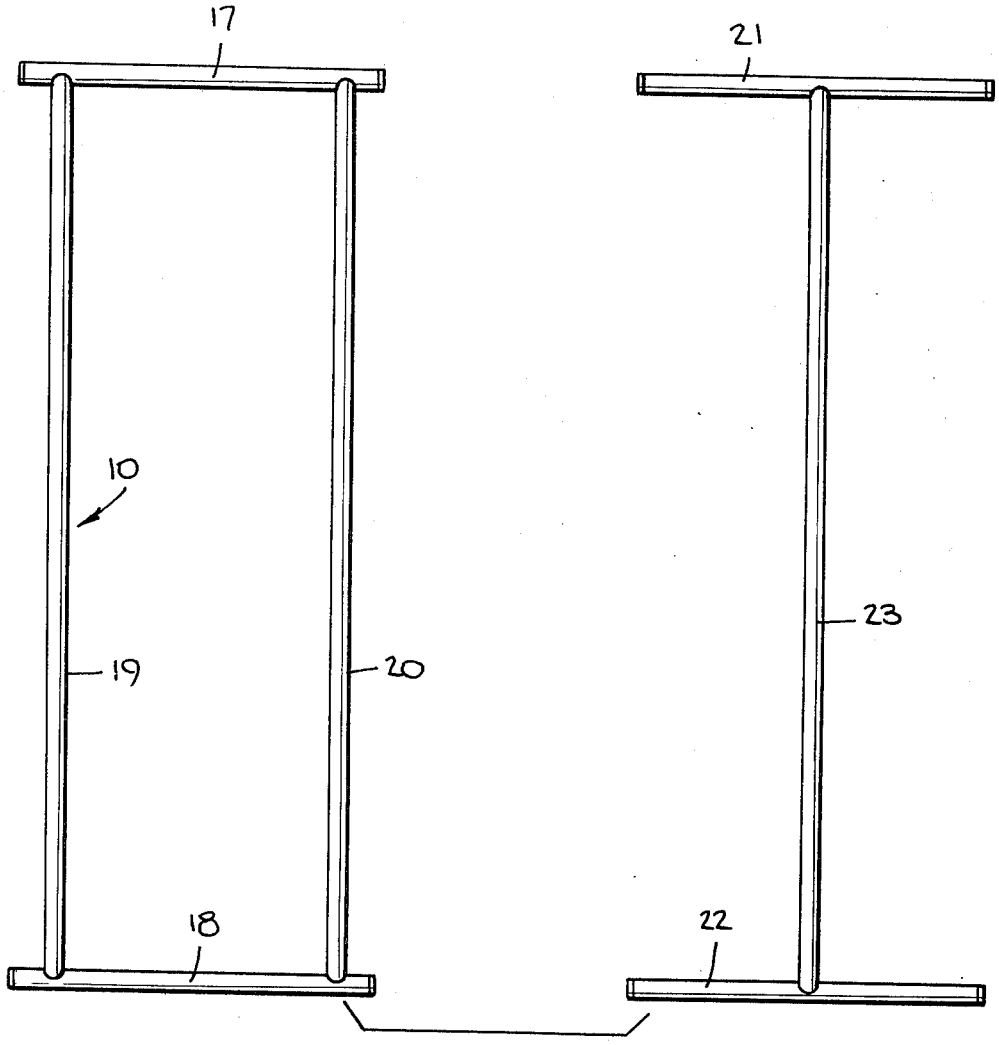
FIG. 4 is an elevational view showing the front and rear frame elements of the easel.

The front and rear elements 10 and 11, which are shown separately in FIG. 4, are preferably fabricated of highstrength tubular metal such as stainless steel or aluminum piping having an attractive polished or plated surface formation. Alternatively, the piping may be formed of strong plastic material such as polypropylene, this having the advantage of greater lightness.

Front frame element 10 is formed by a pair of horizontal arms 17 and 18 which are bridged by a pair of parallel legs 19 and 20, the legs being welded or otherwise joined to the arms at points of connection inwardly displaced from the ends of the arms.

Rear frame element 11 is formed by a pair of horizontal arms 21 and 22 whose dimensions match those of the arms of the front element. Arms 21 and 22 are bridged by a single leg 23 which is joined to the arms at the midpoints thereof. The ends of the front and rear element arms are sealed by closure caps 24. Thus the overall width and length of the front and rear elements are identical, and when the frame is dismantled, the elements thereof may be stacked one on top of the other in a compact box for shipment or storage.

Figure 5:
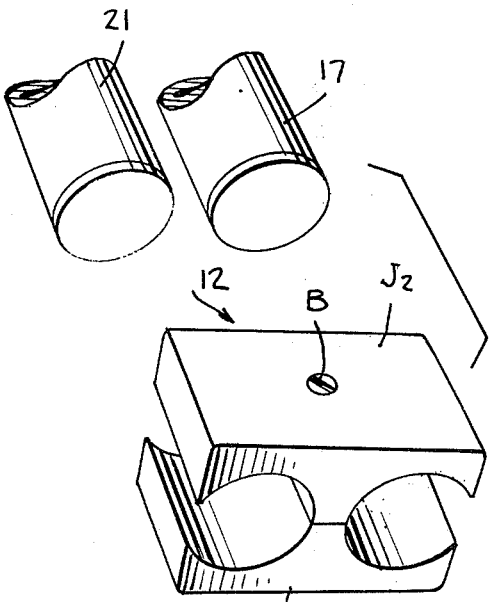
FIG. 5 is a perspective view of the coupler for adjustably interconnecting the front and rear frame elements of the easel.
Figure 6:
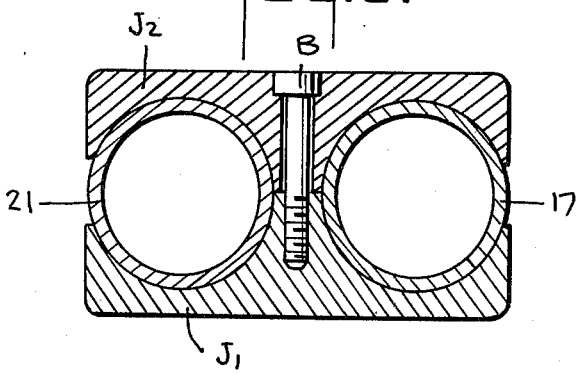
FIG. 6 is a sectional view of the coupler.

As illustrated separately in FIGS. 5 and 6, each double-barreled coupler (12 and 13) is composed of a pair of complementary jaws $J_1$ and $J_2$. Each jaw is formed with a pair of arcuate recesses in spaced relation such that when the jaws are joined together by means of a removable bolt B, the complementary recesses combine to define a pair of barrels which are dimensioned to receive and clamp the outstretched ends of upper arms 17 and 21 of front and rear elements 10 and 11 of the easel frame.

In order to adjust the angle between front and rear elements 10 and 11 so that the frame resting on the floor is stable and the material displayed on the panel is at a suitable angle for viewing, one merely loosens bolt B sufficiently to permit a hinging action between the frame elements. After the elements are positioned to assume the desired caret angle, the bolt is then tightened to hold this angle.

Because couplers 12 and 13 maintain upper arms 17 and 21 of elements 10 and 11 in spaced relation, this space serves to accommodate hook 15 of the display panel, making it possible to suspend the panel from the frame, with the body of the panel lying against legs 19 and 20 of the front element.

The location of pins $P_1$ and $P_2$ is such that the upper edge of the flip-chart pad F—C lies adjacent the top surface of the upper arm 17 of front element 10. Hence when turning over the sheets of the pad, the turned-over sheets pass over the upper arms of the frame and lie against the rear element, thereby facilitating rapid flipping.

Figure 8:
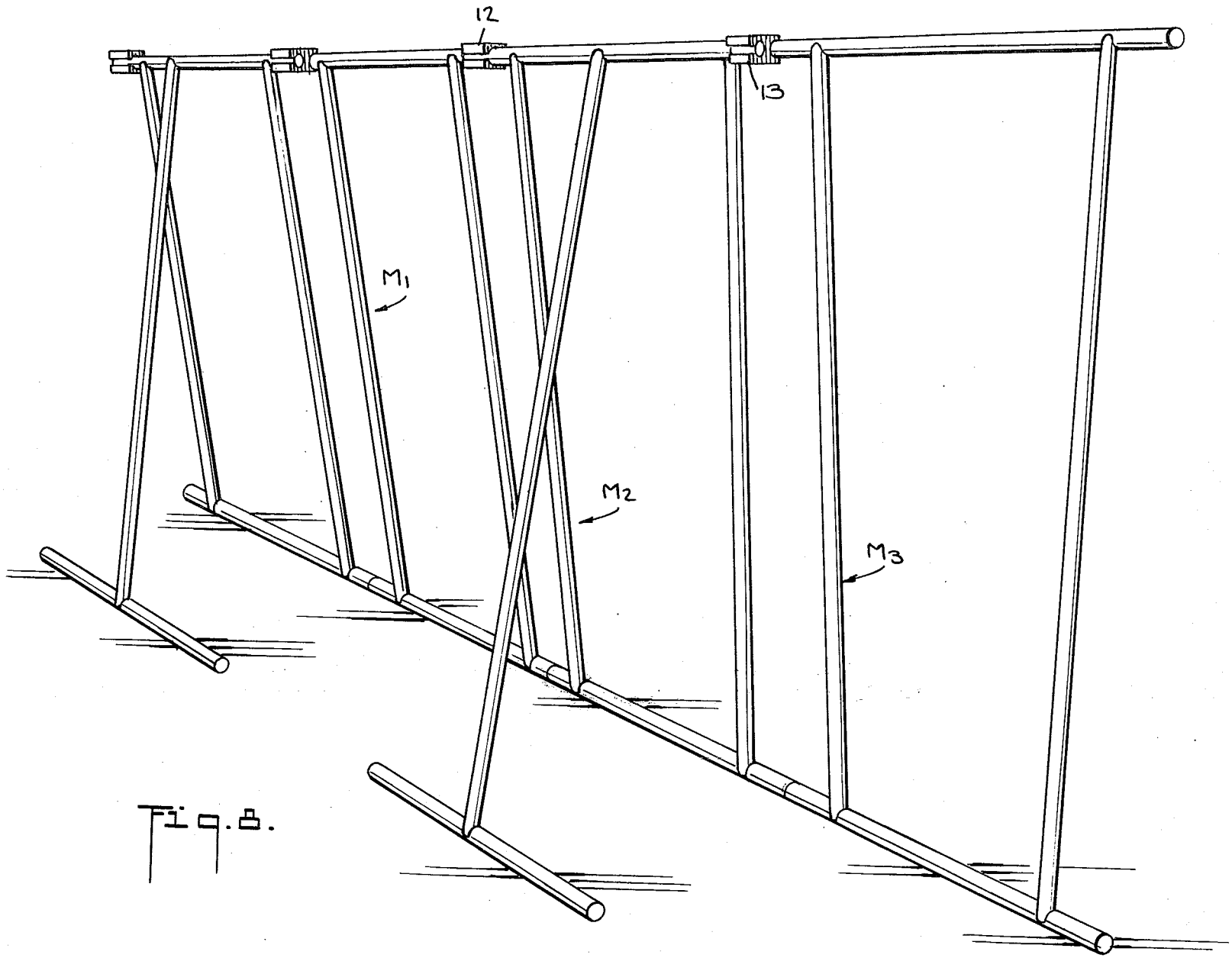
FIG. 8 is a perspective view illustrating the self-supporting wall constituted by three intercoupled modular easels in accordance with the invention.

In the single module shown in FIGS. 1 and 2, the couplers have a width equal to the size of the end extensions of upper arm 17, the outer face of the couplers being flush with the extensions. But when one wishes to join three modules $M_1$, $M_2$ and $M_3$ in side-by-side relation, as shown in FIG. 8, then couplers 12 and 13 of the intermediate module $M_2$ are set up to interengage the upper arms of all three modules to form a joint therebetween. For this purpose, the arms of each module, instead of being fully inserted in the couplers, are inserted halfway therein, so that the couplers, in addition to intercoupling the upper arms of each module, serve to interconnect the modules.

One can, of course, join together as many modules as is necessary to form a free-standing wall of any desired length to support, for purposes of display, elongated material which cannot be carried on a single module.

Because the panels are suspended from the modules and are readily removable therefrom, one may provide panels of different length and of a different material. For example, the panels may be in peg-board form so that a variety of articles may be attached by suitable clips to the panels for display purposes.

In some instances, it may be desirable to have the front element of the frame assume a vertical rather than an inclined position, so that one can, for example, form a multi-module wall to define an exhibition or gallery area for displaying paintings. In this event, rear element 11 of the easel frame may be designed to have a greater length than front element 10, so that when the front element is vertical, the rear element can be angled with respect thereto to support the front element.

While there has been shown and described a preferred embodiment of a collapsible easel module in accordance with the invention, it will be appreciated that many changes and modifications may be made therein without, however, departing from the essential spirit thereof.

Thus, as shown in FIG. 8, when several modules are joined together, not all modules need have rear elements, for if every other module has a rear element, this generally provides adequate support for the multi-module wall. Hence those modules which lack rear elements serve as extension sections.

I claim:

1. A collapsible easel module adapted to support flip-chart pads or other material to be displayed, said module comprising:

A a front frame element formed by upper and lower horizontal arms bridged by a pair of parallel legs at points of connection displaced from the ends of the arms;

B a rear element formed by corresponding upper and lower arms bridged by a single leg connected to said arms at the midpoints thereof;

C double-barreled couplers engaging the complementary ends of the upper arms of the front and rear elements to hold the arms in parallel relation and to maintain a desired caret angle therebetween; and D a display panel whose upper end is curved backwardly to define a hook which is receivable in the space between the parallel upper arms of the frame, whereby the panel is suspended therefrom.

2. A module as set forth in claim 1, wherein the leg of the rear element is the same length as the legs of the front element.

3. A module as set forth in claim 1, wherein the leg of the rear element is longer than the legs of the front element.

4. A module as set forth in claim 1, wherein said frame elements are formed of tubular metal, the ends of the arms being capped.

5. A module as set forth in claim 1, wherein the upper lower end of the panel is curved forwardly to define a transverse shelf.

6. A module as set forth in claim 1, wherein said panel is formed of a translucent moldable plastic sheet.

7. A module as set forth in claim 1, wherein said panel is provided adjacent its upper end with a pair of spaced projecting pins adapted to support a flip-chart pad having holes to receive the pins.

8. A module as set forth in claim 1, wherein said double-barreled couplers are each constituted by a pair of jaws having two spaced arcuate recesses, whereby when the jaws are joined together by a bolt, the complementary recesses form double barrels.

9. A module as set forth in claim 8, wherein each coupler has a width large enough to interengage the ends of the upper arms of adjoining modules, whereby two or more modules may be joined together in side-by-side relation.

* * * * *

UNITED STATES PATENT OFFICE

CERTIFICATE OF CORRECTION

PATENT NO. : 3,980,267

DATED : September 14, 1976

INVENTOR(S) : Evan Palmer

It is certified that error appears in the above-identified patent and that said Letters Patent are hereby corrected as shown below:

Column 3, line 11 "highstrength" should have read
-- high-strength --

Column 4, line 47 "rear element" should have read

-- rear frame element --

Signed and Sealed this

Twenty-third Day of November 1976

[SEAL]

*Attest:*

RUTH C. MASON
*Attesting Officer*

C. MARSHALL DANN
*Commissioner of Patents and Trademarks*